United States Patent [19]

Endo

[11] 4,316,277

[45] Feb. 16, 1982

[54] ELECTRONIC CLOCK MOVEMENT ASSEMBLY

[75] Inventor: Itaru Endo, Showa, Japan

[73] Assignee: Rhythm Watch Company Limited, Tokyo, Japan

[21] Appl. No.: 168,201

[22] Filed: Jul. 10, 1980

[30] Foreign Application Priority Data

Jul. 13, 1979 [JP] Japan ..... 54-96685[U]

[51] Int. Cl.[3] ..... G04B 19/00; G04C 23/02

[52] U.S. Cl. ..... 368/76; 368/88; 368/204

[58] Field of Search ..... 368/62, 76, 88, 203, 368/204, 276, 286, 287, 156, 300, 180

[56] References Cited

U.S. PATENT DOCUMENTS

| | | | |
|---|---|---|---|
| 3,583,148 | 6/1971 | Wolher | 368/276 X |
| 3,583,149 | 6/1971 | Ganter | 368/156 |
| 3,911,663 | 10/1974 | Kern et al. | 368/204 |

*Primary Examiner*—Vit W. Miska

*Attorney, Agent, or Firm*—Koda and Androlia

[57] ABSTRACT

An electronic clock movement structure in which pressure to the contact plates by attachment of the upper case to the lower case does not electrically connect the contact plates with the circuit base plate but also holdingly attaches the gear train combination to the lower case.

3 Claims, 4 Drawing Figures

ELECTRONIC CLOCK MOVEMENT ASSEMBLY

BACKGROUND OF THE INVENTION

1. Field of the Invention

The present invention relates to an electronic clock movement structure and more particularly to an electronic clock movement structure in which contact plates and electronic circuits make contact to be electrically conductive as well as groups of a gear train rotatingly supported by the supporting plates are correctly fixed to a casing.

2. Prior Art

The gear train combination was heretofore held between two supporting plates, and both two supporting plates were fixed to a lower case by screws. An upper case was further attached to cover the gear train combination for the purpose of protection from duct, etc. Leading lines and plates to the electronic circuit were also fixed by screws. In the prior art such a structure was provided so that the lower case and the upper case were used as the supporting plates, and such conducting means were utilized so that contact plates and the circuit base plate were joined together in conducting the electric current between the circuit and the power source.

The prior art mentioned above, however, has such drawbacks that to manufacture with high accuracy the upper case and lower case, a high quality plastic material must be carefully selected. Not only are parts more expensive, but the long term useage was found to have the problem of secular change caused from temperature, humidity, change in quality, clock oil, etc. An example of the problem of secular change is shown in looseness in fixed sections, conductive instability in contact sections, etc., and the improvement of such disadvantageous points is greatly needed.

SUMMARY OF THE INVENTION

Accordingly, it is the general object of the present invention to provide an electronic clock movement structure in which the lower case and the upper case do not require high manufacturing accuracy and in which looseness in fixed sections and conductive instability do not occur.

In keeping with the principles of the present invention the objects are accomplished with an electronic clock movement structure including a gear train combination in which sets of gear train are held among plural supporting plates at predetermined distances, a lower case holds the gear train combination, a circuit base plate is arranged to be attached to the lower case and the supporting plates, resilient contact plates are facingly arranged to conductive portions of the circuit base plate, an upper case is fixed to the above mentioned lower case in the vicinity of the pressing portion which is made in contact with the contact plates, and having such characteristics that pressure to the above mentioned contact plates by attachment of the upper case does not electrically connect the contact plates with the above mentioned circuit base plate but also holdingly attaches the gear train combination to the above mentioned lower case.

According to the present invention, the contact plates are resiliently deformed to press the circuit base plate which is to be electrically connected as well as to press the supporting plates in the gear train combination which are to be firmly fixed. Accordingly, the looseness in the fixed sections and the conductive portions can be absorbed by the resilient deformation of the contact plates and stable clock accuracy can be maintained.

BRIEF DESCRIPTION OF THE DRAWINGS

The above mentioned and other features and objects of the present invention will become more apparent with reference to the following description taken in conjunction with the accompanying drawings, wherein like reference numerals denote like elements and in which.

DETAILED DESCRIPTION OF THE INVENTION

Figure 1:
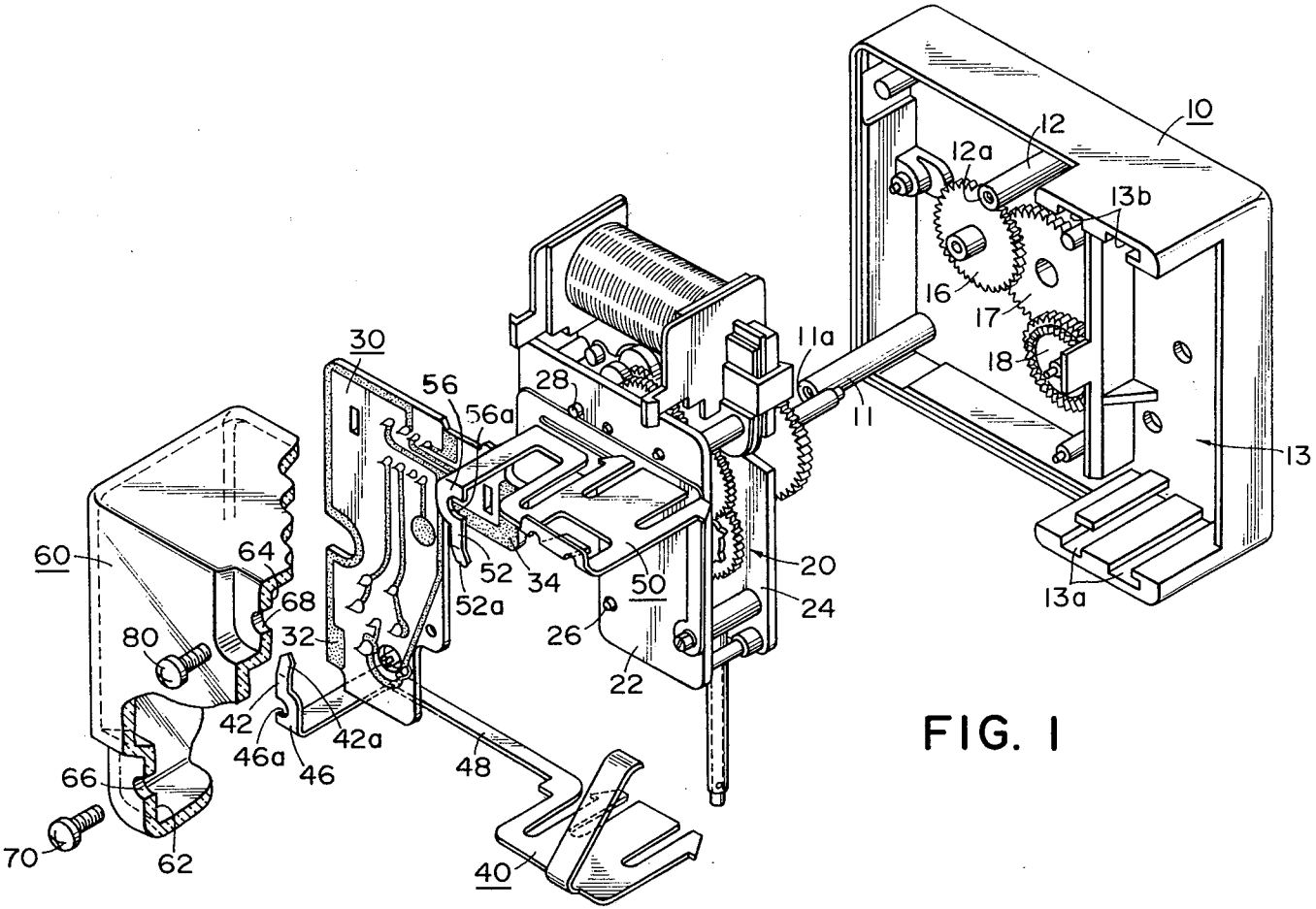
FIG. 1 is an exploded perspective view of an electronic clock movement in accordance with the teachings of the present invention.

Referring to FIG. 1, shown therein is an exploded perspective view of an electronic clock movement in accordance with the teachings of the present invention. The electronic clock movement is generally composed of a lower case 10, supporting plates 22 and 24, time indicating gear trains rotatingly supported by the lower case 10, a circuit base plate 30, contact plates 40 and 50, and an upper case 60. The lower case 10 composes one side of the electronic clock movement casing, and posts 11 and 12 and a battery holder 13 are formed from plastic material by solid mold. The time indicating gear trains 16, 17 and 18 are rotatingly supported by the lower case 10 and the other gear train 20 is rotatingly held between two supporting plates 22 and 24. The electronic clock movement is correctly regulated by rotation of a standard rotation generator such as a motor driven by crystal oscillation pulses or the like, in order to enable time indication. The circuit base plate 30 is coincidentally arranged with the supporting plate 22 and the clock circuit elements are built on the surface of the circuit base plate 30. The circuit base plate 30 is further positioned to make contact with projections 26 and 28 of the supporting plate 22 as well as end surfaces 11*a* and 12*a* of the posts 11 and 12 of the lower case 10.

Contact plates 40 and 50 are formed from resilient material and can be resiliently inserted into the respective channels 13*a* and 13*b* of the battery holder 13 to firmly hold the channels. The contact plates 40 and 50 are composed of contact tongues 42*a* and 52*a*, respectively, capable of making contact with conductive portions 32 and 34 of the circuit base plate 30, arms 42 and 52, fixing sections 46 and 56, and leading portions 48 and 58. In the fixing sections 46 and 56 are formed recesses 46*a* and 56*a* whose center axes coincide with the ones of the posts 11 and 12 of the lower case 10, and the screws 70 and 80 are inserted through the recesses 46*a* and 56*a* to fix the electric clock movement when the upper case is fastened, which is described afterwards.

The upper case 60 composes another side of the electronic clock movement casing. The upper case 60 also includes pressing portions 62 and 64, respectively, capable of pushing the fixing portions 46 and 56 of contact plates 40 and 50, and is shaped by solid mold. In order to fasten the electronic clock movement the screws 70 and 80 are inserted through the screw holes 66 and 68 of the upper case 60 and tightened to fix the upper case 60 to the posts 11 and 12 of the lower case 10, which can completely hold each composition including the time indicating gear train.

Figure 2:
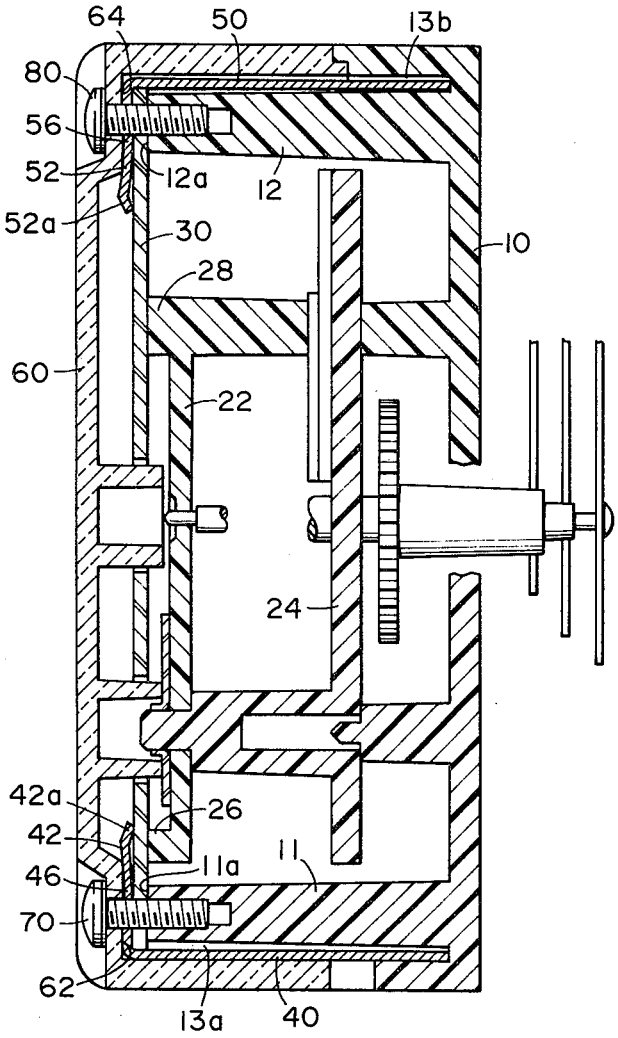
FIG. 2 is a principle sectional view showing the action of the contact plates after the upper case is attached.

In FIG. 2, shown therein is a principle sectional view illustrating the action of the control plates 40 and 50 after the upper case 60 is attached. It is required for the conductive portions 32 and 34 of the circuit base plate 30 and the contact plates 40 and 50 to be electrically conductive. In the present invention, the above mentioned conductive state can be accomplished by the contact tongues 42*a* and 52*a* of the contact plates 40 and 50, respectively making contact with conductive portions 32 and 34 of the circuit base plate 30. In other words, the fixing portions 46 and 56 of the contact plates 40 and 50 are pressingly held toward the direction of the circuit base plate 30 by the pressing portions 62 and 64 of the upper case 60, and the contact tongues 42*a* and 52*a* of the arms 42 and 52 are resiliently made in contact with the conductive portions 32 and 34 of the circuit base plate 30, respectively. It is required at this point that the fixing portions 46 and 56 of the contact plates 40 and 50, the arms 42 and 52 and the contact tongues 42*a* and 52*a* be predetermined so that a resilient pressing force can be correctly applied to the circuit base plate 30.

The above mentioned composition of resilient pressure can be correctly adapted for the looseness produced between the lower case 10 and the upper case 60 by the secular change. In other words, the looseness produced between the lower case 10 and the pressing portions 62 and 64 of the upper case 60 is absorbed by the contact plates 40 and 50 equipped between the circuit base plate 30 and the upper case 60 with a simple change of the resilient deflection amount in the contact plates 40 and 50. Accordingly, the circuit base plate 30 always keeps contact with the supporting plate 22 even if the looseness is produced by the secular change, and the time indicating gear trains are not affected by the above mentioned looseness.

In the present invention, furthermore, the looseness produced between the contact plates 40 and 50 and the circuit base plate 30 can be absorbed by the resilient deflection of the contact plates themselves and poor conductivity caused from the secular change can be easily prevented.

Besides, it is possible to use snap fittings or the like for the means of fastening the upper case to the lower case 10, rather than using screws, as shown in the preferred embodiment.

Figure 3:
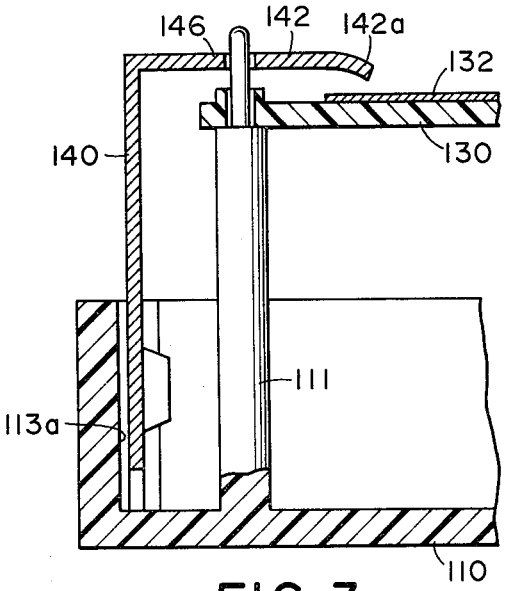
FIG. 3 is a principle sectional view showing the second embodiment of the present invention.
Figure 4:
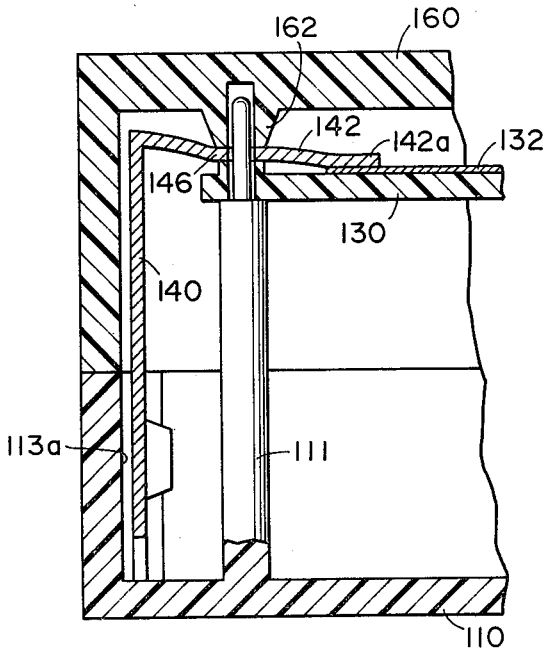
FIG. 4 is a sectional view showing the assembly of the second embodiment illustrated in FIG. 3.

In FIGS. 3 and 4, shown therein is the second preferred embodiment of the electronic clock movement in accordance with the teachings of the present invention. In FIGS. 3 and 4 the connection between the lower case 110 and the upper case 160 is principally illustrated and the supporting plates and the gear train combination are omitted. Also in the second embodiment like reference elements with the first embodiment are denoted by the numerals adding 100 and the description is omitted.

In FIG. 3, shown therein is a principle sectional view illustrating the arrangement of the circuit base plate 130 and the contact plate 140 after they are assembled. As evident from the FIG. 3, the contact tongue 142*a* of the contact plate 140 is arranged facing the conductive portion 132 of the circuit base plate 130, but they stand in the non-contact state. Accordingly, the contact plate 140 in the stage of FIG. 3 does not produce resilient replusion in the installing process of the supporting plates, the gear train combination, and the circuit base plate to the lower case 110, and the automatic assembling system can be adapted for the parts installation to the lower case 110.

In FIG. 4, shown therein is a state of the fixing portion 146 after the upper case 160 is attached. The fixing portion 146 is pressed by the pressing portion 162 of the upper case 160 and the contact tongue 142*a* makes contact with the conductive portion 132. The fixing portion 146, therefore, attains the electric connection with the circuit base plate 132 with high point pressure as well as the hold in the thrusting direction.

The attachment of the upper case 160 to the lower case 110 is generally composed of snap fittings, which are not illustrated in the figure, and the upper case 160 is simply pushed to attach firmly to the lower case 110 in the automatic assembling system.

As described heretofore, the present invention can provide an electronic clock movement structure in which the resilience of the contact plates cannot only absorb the looseness caused from the secular change, but can also prevent from the non-conductive state, and can maintain stable clock accuracy in long term useage even if material of high quality and high accuracy are not used for the casing.

I claim:

1. An electronic clock movement structure comprising:

gear train combination in which sets of gear trains are held among plural supporting plates at predetermined distances;

a lower case holding said gear train combination;

a circuit base plate arranged to be attached to said lower case and said supporting plates;

resilient contact plates facingly arranged to conductive portions of said circuit base plate;

an upper case fixed to said lower case and including pressing portions which engage with said contact plates; and said electronic clock movement structure being characterized in that attachment of said upper case to said lower case applies pressure to said contact plates to electrically connect said contact plates with said circuit base plate and holdingly attach said gear train combination to said lower case.

2. The electronic check movement structure according to claim 1, wherein said contact plates include fixing portions which are interposed to be fixed between said circuit base plate and said upper case, arms resiliently extending from said fixing portions and contact tongues provided in the end of said arms which are pressingly in contact with the said conductive portions on said circuit base plate by resilient force of said contact plates.

3. The electronic clock movement structure according to claim 1 or 2, wherein said circuit base plate attaches to one supporting plate, sets of gear train are supported between two supporting plates, another supporting plate attaches to said lower case, the other sets of gear train are supported between said another supporting plate and said gear train combination is held by means of pressing to fix said upper case to said lower case.

* * * * *